US011719111B1

(12) United States Patent
Menheere

(10) Patent No.: US 11,719,111 B1
(45) Date of Patent: Aug. 8, 2023

(54) VARIABLE GUIDE VANE SYSTEM

(71) Applicant: PRATT & WHITNEY CANADA CORP., Longueuil (CA)

(72) Inventor: David Menheere, Norval (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 17/809,694

(22) Filed: Jun. 29, 2022

(51) Int. Cl.
*F01D 9/04* (2006.01)
*F01D 17/16* (2006.01)
*F01D 11/08* (2006.01)

(52) U.S. Cl.
CPC ..... *F01D 9/042* (2013.01); *F01D 9/041* (2013.01); *F01D 11/08* (2013.01); *F01D 17/162* (2013.01); *F05D 2220/323* (2013.01); *F05D 2240/11* (2013.01); *F05D 2260/36* (2013.01); *F05D 2260/50* (2013.01)

(58) Field of Classification Search
CPC ..... F01D 9/042; F01D 9/041; F01D 11/08; F01D 17/162; F05D 2240/11; F05D 2260/36; F05D 2260/50
See application file for complete search history.

(56) References Cited

U.S. PATENT DOCUMENTS

| | | | | |
|---|---|---|---|---|
| 3,723,021 | A * | 3/1973 | Bartholomew | F01D 5/148 415/161 |
| 4,029,433 | A | 6/1977 | Penny et al. | |
| 8,257,021 | B2 | 9/2012 | Lee | |
| 10,273,976 | B2 * | 4/2019 | Jemora | F04D 29/563 |
| 11,092,167 | B2 * | 8/2021 | Urac | F01D 17/162 |
| 2001/0016091 | A1 * | 8/2001 | Mesing | F04D 29/023 384/300 |
| 2009/0208338 | A1 * | 8/2009 | Major | F01D 11/001 416/218 |
| 2015/0330301 | A1 * | 11/2015 | Cedoz | F02C 7/36 60/791 |

* cited by examiner

*Primary Examiner* — Brian Christopher Delrue
(74) *Attorney, Agent, or Firm* — Norton Rose Fulbright Canada LLP.

(57) ABSTRACT

A vane system for an aircraft engine, comprising: an inner wall extending circumferentially about a duct axis; an outer wall extending circumferentially about the duct axis radially outward of the inner wall relative to the duct axis; at least one vane extending from an inner end attached to the inner wall to an outer end rotatably connected to the outer wall, the outer end rotatable relative to the outer wall about a vane axis at an angle to the duct axis; a ring extending circumferentially about the duct axis radially outward of the outer wall relative to the duct axis, the ring rotatable about the duct axis; and at least one transmission member located radially outward of the outer wall relative to the duct axis and coupling the ring to the outer end such that rotating the ring about the duct axis rotates the outer end about the vane axis.

18 Claims, 3 Drawing Sheets

VARIABLE GUIDE VANE SYSTEM

TECHNICAL FIELD

The disclosure relates generally to variable guide vane systems and, more particularly, to variable guide vane systems for aircraft engines.

BACKGROUND

Turbine engines sometimes have variable guide vanes (VGVs) disposed in an inlet section, a compressor section or a turbine section. A position of each guide vane is adjustable relative to a gas path in order to control the flow being directed through the gas path. An actuator located outside the gas path is used to move the VGVs into position. Control of the position of the VGVs remains a challenge.

SUMMARY

In accordance with an aspect of the present disclosure, there is provided a variable guide vane system for an aircraft engine, comprising: an inner duct wall extending circumferentially about a duct axis; an outer duct wall extending circumferentially about the duct axis radially outward of the inner duct wall relative to the duct axis; at least one vane extending from an inner vane end attached to the inner duct wall to an outer vane end rotatably connected to the outer duct wall, the outer vane end rotatable relative to the outer duct wall about a vane axis extending at an angle relative to the duct axis; a drive ring extending circumferentially about the duct axis radially outward of the outer duct wall relative to the duct axis, the drive ring rotatable about the duct axis; and at least one transmission member located radially outward of the outer duct wall relative to the duct axis and coupling the drive ring to the outer vane end such that rotating the drive ring about the duct axis rotates the outer vane end about the vane axis.

In accordance with another aspect of the present disclosure, there is provided an aircraft engine comprising: a duct defining a flow path, the duct including an inner duct wall and an outer duct wall respectively extending circumferentially about a duct axis and defining radially inner and outer boundaries of the flow path; at least one vane having an airfoil extending in the flow path from an inner vane end attached to the inner duct wall to an outer vane end pivotally connected to the outer duct wall, the outer vane end pivotable relative to the outer duct wall about a vane axis extending at an angle relative to the duct axis; a first drive ring and a second drive ring extending circumferentially about the duct axis radially outward of the outer duct wall relative to the duct axis, the first drive ring and the second drive ring spaced axially from one another relative to the duct axis and pivotable about the duct axis; at least one transmission member including a beam extending from the first drive ring to the second drive ring radially outward of the outer vane end relative to the duct axis, and a beam connector joined to the beam and matingly engaged with the outer vane end to be rotatable with the outer vane end about the vane axis; and an actuator operatively coupled to the first drive ring and the second drive ring to pivot the first drive ring and the second drive ring about the duct axis.

BRIEF DESCRIPTION OF THE DRAWINGS

Reference is now made to the accompanying figures in which.

DETAILED DESCRIPTION

The terms "attached", "coupled", "connected", "engaged", "mounted" and other like terms as used herein may include both direct attachment, coupling, connection, engagement or mounting (in which two components contact each other) and indirect attachment, coupling, connection, engagement or mounting (in which at least one additional component is located between the two components).

The term "generally" and other like terms as used herein may be applied to modify any quantitative representation which could permissibly vary without resulting in a change in the basic function to which it is related.

Aspects of various embodiments will now be described through reference to the drawings.

Figure 1:
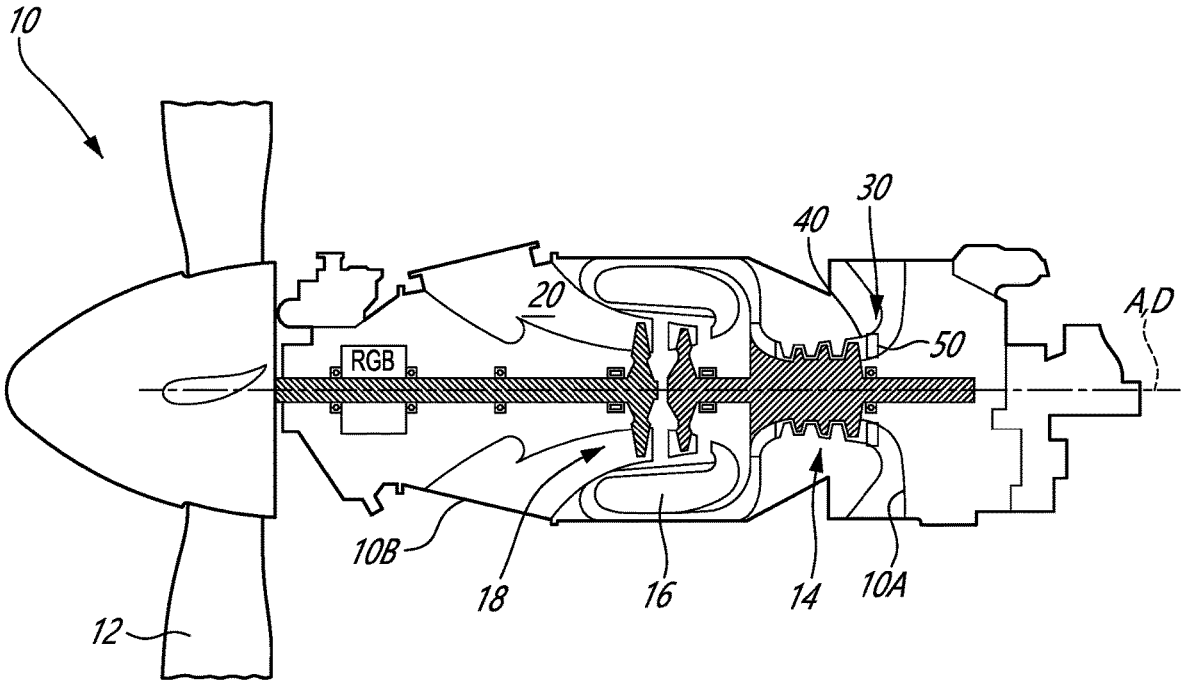
FIG. 1 is a schematic cross-sectional view of an aircraft engine.

FIG. 1 illustrates a turbine engine 10 which may for example be part of an aircraft. Depending on the implementation of the present technology, the engine 10 could be any type of turbine engine including but not limited to a turbojet engine, a turbofan engine, a turboprop engine, and a turboshaft engine. In the illustrated example, the engine 10 is of the turboprop type and generally comprises in serial flow communication a propeller 12, an inlet duct 10A, a compressor section 14 for pressurizing air drawn from the inlet duct 10A, a combustor section 16 in which the compressed air is mixed with fuel and ignited for generating an annular stream of hot combustion gases, and a turbine section 18 for extracting energy from the combustion gases ultimately expelled through an exhaust duct 10B. A flow path 20 of the engine 10 having opposite ends defined respectively by the inlet duct 10A and the exhaust duct 10B and into which compressor and turbine rotor discs of the compressor and turbine sections 14, 18 extend. The engine 10 may be provided with one or more variable guide vane systems 30 (hereinafter, VGV system 30) to locally regulate the flow of fluid in the flow path 20 at a given axial location relative to a central axis A of the engine 10, for example upstream of an upstream-most stage of the compressor section 14 as schematically shown in FIG. 1. Although the embodiment depicted in FIG. 1 shows that the engine 10 has a sole VGV system 30 located upstream of the compressor section 14, it shall be understood that depending on the embodiment, the engine 10 may include one or more VGV systems 30, one or more of which may be located elsewhere in the engine 10, for example downstream of a rotor of the compressor section 14. More than one VGV systems 30 may be provided in a given section of the engine 10. In embodiments, no VGV system 30 is provided upstream of the compressor section 14.

Figure 2:
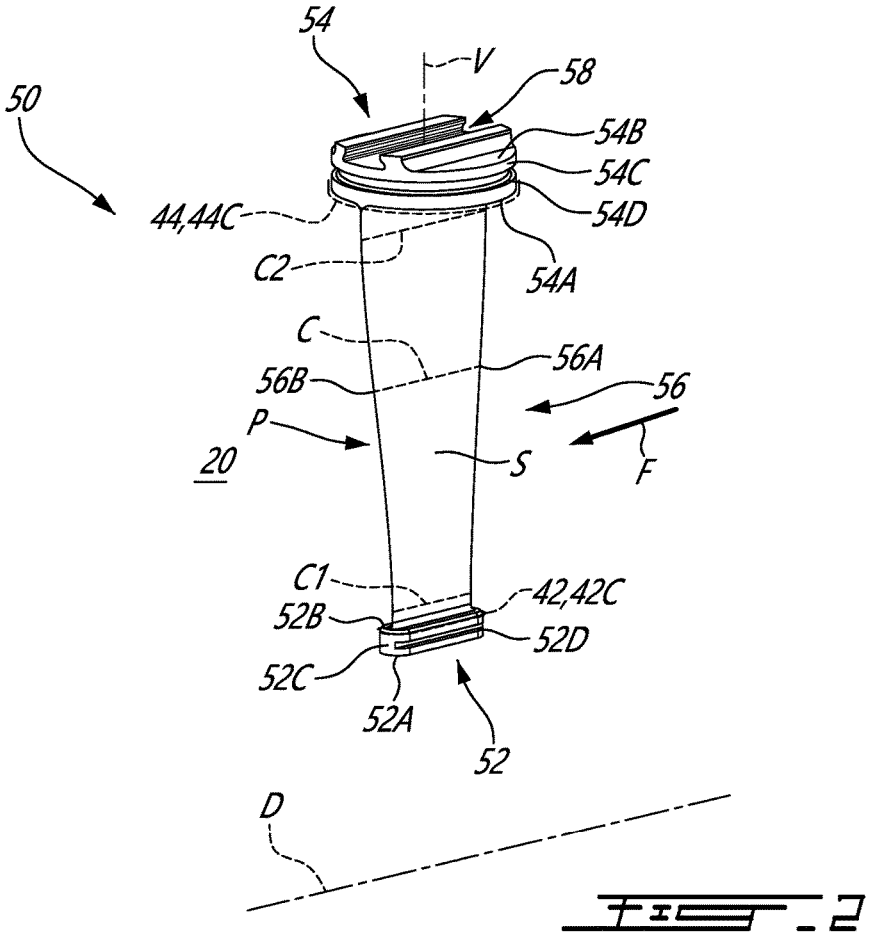
FIG. 2 is a perspective view of a vane of a variable guide vane (VGV) system of the aircraft of FIG. 1.
Figure 3:
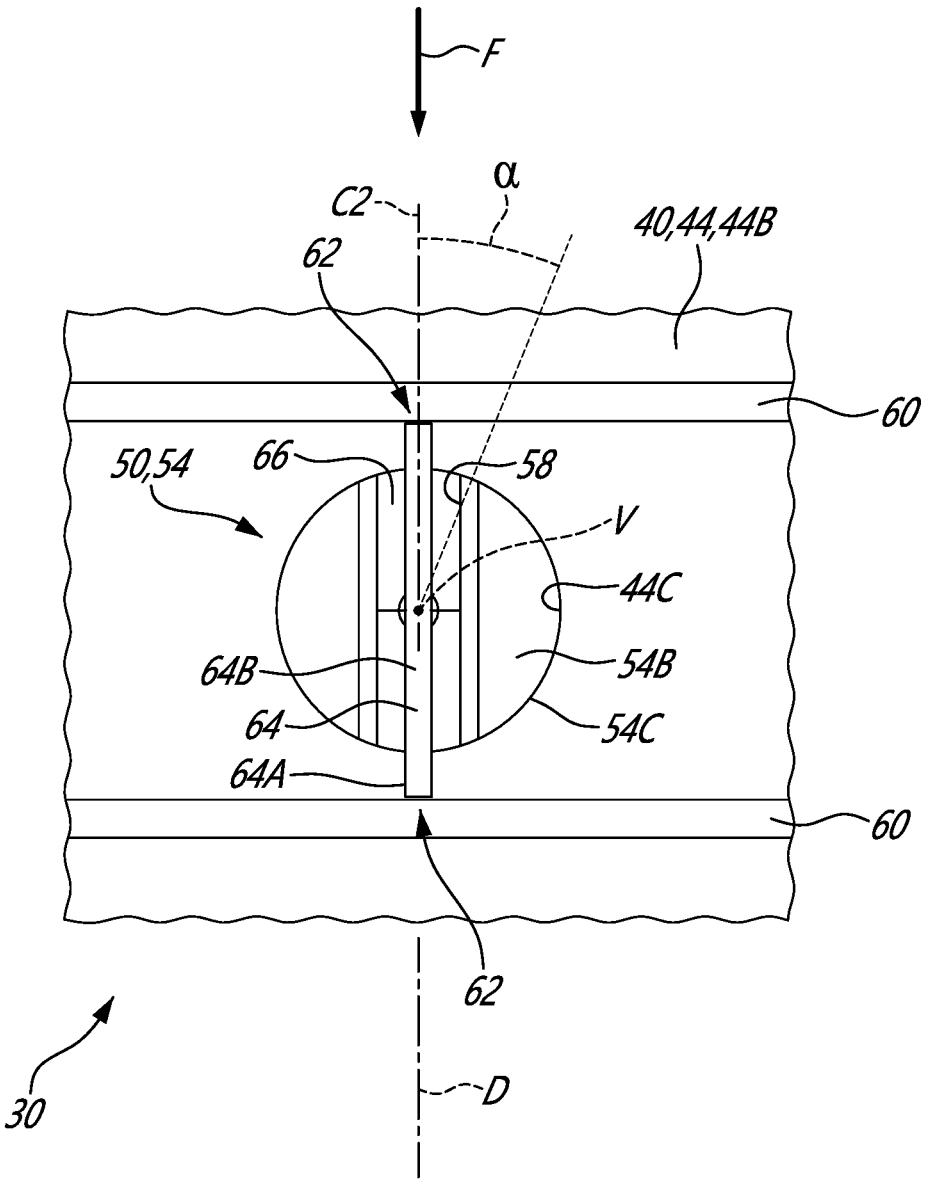
FIG. 3 is a top planar view of a VGV system according to embodiments.
Figure 4A:
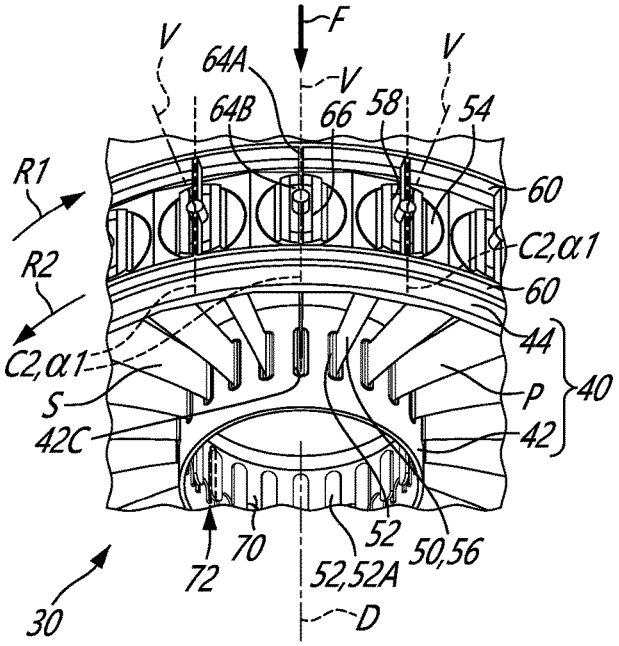
FIGS. 4A-4B are perspective views of the VGV system of FIG. 3, with vanes thereof shown in an undeformed state.
Figure 4B:
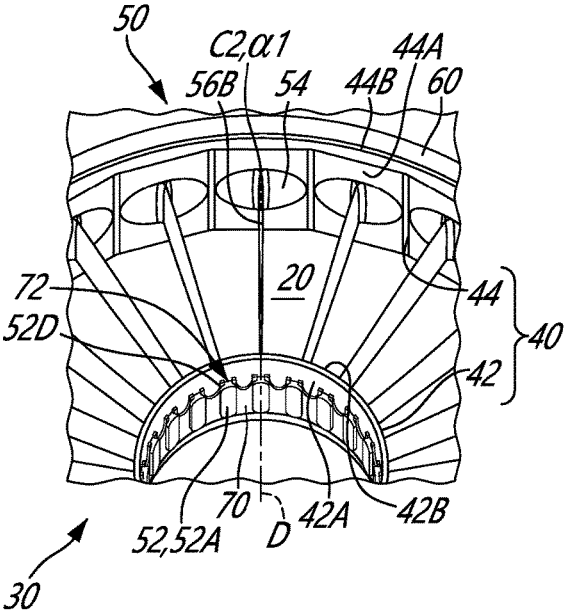

With reference to FIGS. 2-4B, exemplary implementations of the VGV system 30 will be described in further detail. The VGV system 30 generally comprises a duct 40 defining a portion of the flow path 20. The duct 40 includes an inner duct wall 42 and an outer duct wall 44 respectively extending circumferentially about a duct axis D. As seen in FIG. 4B, the inner duct wall 42 has a radially inner surface 42A outside of the flow path 20 and a radially outer surface 42B defining a radially inner boundary of the flow path 20. The outer duct wall 44 has a radially inner surface 44A defining a radially outer boundary of the flow path 20 and a radially outer surface 44B outside of the flow path 20. The VGV system 30 also generally comprises at least one vane 50 that is suitably mounted to the duct 40 so as to extend across the flow path 20. In most embodiments, the VGV system 30 includes an array of vanes 50 that are circumferentially spaced apart from one another relative to the duct axis D. As will be described in further detail hereinbelow, a portion of each vane 50 is rotatable relative to the duct 40 (and hence the flow path 20) about a vane axis V to an angle of attack α (FIG. 3) relative to a direction of the flow of air inside the flow path 20, schematically shown by arrow F, to selectively adjust the regulation of the flow F. Also comprised by the VGV system 30 are a drive ring 60 rotatable about the duct axis D, and at least one transmission member 62 coupling the drive ring 60 to the rotatable portion of the vane 50 such that the latter is caused to rotate as the drive ring 60 rotates. Rotation of each vane 50 about its respective vane axis V is governed by a control system (not shown) of the engine 10 generally comprising an actuator operatively coupled to the drive ring 60 to rotate the drive ring 60 about the duct axis D. In some embodiments, the control system is part of the VGV system 30. In some such embodiments, the drive ring 60 is part of the control system.

Referring to FIG. 2, each vane 50 generally includes an inner vane end 52, an outer vane end 54 and an airfoil 56, or aero surface, extending from the inner vane end 52 to the outer vane end 54. The airfoil 56 is a portion of the vane 50 having a cross-section profile suitable for directing the oncoming flow of air F to regulate the flow of air F, that is, to impart desired aerodynamic properties to the flow of air F downstream thereof. The airfoil 56 has opposite lateral sides including a suction side S that is generally associated with a higher flow velocity and a lower static pressure, and a pressure side P that is generally associated with a lower flow velocity and a higher static pressure. Each airfoil 56 also has an upstream side defined by a leading edge 56A located at an upstream junction between the suction and pressure sides S, P, and a downstream side defined by a trailing edge 56B located at a downstream junction between the suction and pressure sides S, P. The leading and trailing edges 56A, 56B may also be said to form vertices of the cross-section profile of the airfoil 56. A notional straight line connecting the vertices is conventionally referred to as a chord C, or chord line. An orientation of the chord C relative to the flow F defines the angle of attack α. The chord C may vary in orientation, and hence define different angles of attack α, depending on the location along the length of the airfoil 56. Also, the chord C may have different sizes depending on the location. For example, the airfoil 56 may be said to have a first chord C1 adjacent or proximate to the inner vane end 52 and a second chord C2 adjacent or proximate to the outer vane end 54. In the depicted embodiment, the first chord C1 is shorter than the second chord C2. Also, upon the airfoil 56 being in an underformed state, the first and second chords C1, C2 in this case define a same angle of attack α, and are parallel to one another and the airfoil 56 extends linearly therebetween (i.e., the first and second chords C1, C2 are radially spaced from one another and circumferentially aligned). Other relative spatial arrangements of the first and second chords C1, C2 are possible.

The inner vane end 52, also referred to as a foot or base of the vane 50, is structured so as to be held in place relative to the inner duct wall 42. Various means for holding the inner vane end 52 relative to the inner duct wall 42 are contemplated, including permanent attachment methods such as welding, interference fitting, among others. In the depicted embodiment, an exemplary reversible attachment method is implemented for holding the inner vane end 42. The inner vane end 52 has an inner surface 52A, an outer surface 52B, and a peripheral surface 52C surrounding the inner and outer surfaces 52A, 52B. The peripheral surface 52C in this case closely follows the shape of the airfoil 56 at its junction with the inner vane end 52, such that the span of the outer surface 52A is minimized. The outer surface 52A may nonetheless define a portion of the flow path 20. The inner duct wall 42 defines an opening 42C in its radially outer surface 42B that has a shape complementary to that of the peripheral surface 52C, which in this case hinders rotation of the inner vane end relative to the vane axis V. The inner vane end 52 is received inside the opening 42C. The opening 42C is in this case a through opening, i.e., it extends from the radially outer surface 42B to the radially inner surface 42A of the inner duct wall 42. The inner vane end 52 is sized such that upon its outer surface 52B being radially flush with the radially outer surface 42B of the inner duct wall 42, a portion of the inner vane end 52 having the inner surface 52A protrudes radially inwardly from the radially inner surface 42A. A fastener 70 fastens the protruding portion of the inner vane end 52 to the inner duct wall 42. The fastener 70 may for example be a retaining clip 72 that engages the protruding portion of the inner vane end 52 and extends to outward of the peripheral surface 52C so as to hinder withdrawal of the inner vane end 52 from the opening 42C. The protruding portion may for example have a slot 52D defined in the peripheral surface 52C inside which an arm of the retaining clip 72 may be received. The fastener 70 in this case is a retaining ring extending circumferentially about an axis (such as the duct axis D) and having a series of circumferentially spaced apart retaining shapes that are suitable for engaging the inner vane ends 52 of a series of vanes 50 received inside corresponding openings 42C of the inner duct wall 42. This implementation of the fastener 70 may be described as a series of retaining clips 72 joined together so as to form an integral piece. Other types of fasteners 70 are contemplated, such as pins, screws, etc. Upon the inner vane end 52 being attached to the inner duct wall 42, the first chord C1 is maintained at a fixed angle relative to the duct axis D. In the present embodiment, the first chord C1 is maintained parallel to the duct axis D, although other spatial arrangements of the inner vane end 52 relative to the duct 40 are contemplated.

Still referring to FIG. 2, the outer vane end 54, also referred to as a tip or head of the vane 50, is rotatably connected relative to the outer duct wall 44. The outer vane end 54 has an inner surface 54A, an outer surface 54B, and a peripheral surface 54C surrounding the inner and outer surfaces 54A, 54B. The peripheral surface 52C in this case is cylindrical in shape, and is sized so as to closely circumscribe the airfoil 56 at its junction with the outer vane end 54. A diameter of the peripheral surface 52C (and of the inner surface 54A) may generally correspond to the second chord C2. The outer duct wall 44 has an opening 44C in its radially inner surface 44A that is circumscribed by an opening surface having a shape complementary to that of the peripheral surface 54C. The outer vane end 54 is received inside the opening 44C. The opening 44C is a through opening, i.e., it extends from the radially inner surface 44A to the radially outer surface 44B of the outer duct wall 44, and is in this case cylindrical. It is contemplated that the peripheral surface defining the opening 44C could otherwise be tapered and/or shouldered so as to define a seat for the outer vane end 54 to radially engage the outer duct wall 44. The peripheral surface 54C extends circumferentially about the vane axis V, and the opening surface extends circumferentially about an opening axis that is at an angle relative to the duct axis D. In this case, the opening axis extends radially relative to the duct axis D. The opening surface and the peripheral surface 54C may be said to be shaped to cooperate with one another as the outer vane end 54 is received inside the opening 44C to orient the outer vane end 54 relative to the outer duct wall 44 such that the vane axis V becomes collinear with the opening axis. When the outer vane end 54 is received inside the opening 44C, the opening surface extends circumferentially about the vane axis V. The opening surface and the peripheral surface 54C may be said to form complementary portions of a rotational joint governing the rotation of the outer vane end 54 relative to the outer duct wall 44 about the vane axis V.

The outer vane end 54 in this case has a circumferential groove 54D extending into the peripheral surface 54C. An annular seal (not shown) of the VGV system 30 is sealingly engaged between the opening surface of the outer duct wall 44 and the peripheral surface 54C of the outer vane end 54. This arrangement of the annular seal is an exemplary one of several means contemplated prevent egress of fluid from the flow path 20 via the opening 44C. The outer vane end 54 also has a vane connector 58 via which rotation of the outer vane end 54 with the adjacent portion of the airfoil 56 defining the second chord C2 (and hence modification of the angle of attack $\alpha$) may be induced. The vane connector 58 in this embodiment is provided in the form of a slot defined in a portion of the outer vane end 54 that projects from the outer surface 54B. In this embodiment, the vane connector 58 extends to radially outward of the radially outer surface 44B of the outer duct wall 44 relative to the duct axis D, whereas the outer surface 54B is flush with the radially outer surface 44B.

Referring to FIG. 3, the drive ring 60 and the transmission member 62 will now be described in further detail. The drive ring 60 in this embodiment includes two drive rings 60, i.e., a first drive ring 60 and a second drive ring 60, that are spaced axially from one another relative to the duct axis D on either side of the vane axis V and located radially outward of the outer duct wall 44. Each drive ring 60 has a corresponding transmission member 62, i.e., a first and a second transmission member 62 via which it is coupled to the outer vane end 54, namely to the vane connector 58. It is contemplated however that a sole drive ring 60 with a sole transmission member 62 may be used. Various types of transmission members 62 are contemplated, including non-deformable types such as geared arrangements, and deformable types such as the one described hereinbelow. In embodiments having deformable transmission members 62, the first and second transmission members 62 may form a unitary piece. Each drive ring 60 and its corresponding transmission member 62 may form a unitary piece. The first and second drive rings 60, and the first and second transmission members 62 (which may form a sole transmission member interconnecting the drive rings 60) may together form a unitary piece. In one exemplary arrangement, each transmission member 62 includes a beam 64 extending longitudinally from a first beam end 64A joined to its corresponding drive ring 60 to a second beam end 64B that is closer to the vane axis V than the first beam end 64A. Each transmission member 62 engages the outer vane end 54 proximate to the second beam end 64B. The beams 64 may be said to form a sole beam extending from the first drive ring 60 to the second drive ring 60 radially outward of the outer vane end 54, and the second beam ends 64B may in this case correspond to a longitudinal center of the sole beam. By this arrangement, rotation of the drive ring 60 about the duct axis D induces a torque to the outer vane end 54 about the vane axis V via the transmission member 62. In the present embodiment, the transmission member 62 includes a beam connector 66 joined to the beam 64 at the second beam end 64B, and engages the outer vane end 54 via mating engagement between the beam connector 66 and the vane connector 58. The beam 64 extends between its ends 64A, 64B at a location that is radially outward of the outer vane end 54, and the beam connector 66 extends radially inwardly from the beam 64 to the vane connector 58. The beam connector 64 and the vane connector 58 have complementary shapes that hinder rotation of the beam connector 66 relative to the vane connector 58 about the vane axis V. In this particular embodiment, the beam connector 66 and the vane connector 58 define a prismatic joint that hinders radial displacement of the beam connector 66 relative to the vane connector 58, yet allows a transverse, linear displacement therebetween. The direction along which the prismatic joint allows displacement is parallel to the duct axis D. The vane connector 58 is provided in the form of a slot, and the beam connector 66 is provided in the form of a rail. In other embodiments, the vane connector 58 may be a rail and the beam connector 66 may be a slot. This arrangement of the vane connector 58 and the beam connector 66 may be convenient for the assembly of the VGV system 30. For example, to assemble the VGV system 30, the vanes 50 may be inserted through corresponding openings 44C of the outer duct wall 44 until the inner vane ends 52 are received in corresponding openings 42C of the inner duct wall 42. The fastener(s) 70 may then be installed to attach the inner vane ends 52 to the inner duct wall 42. Then, the drive ring(s) 60 may be slid around the duct 40 in an axial direction parallel to the duct axis D, with the beam connectors 66 and the vane connectors 68 circumferentially aligned so that their mating engagement may occur.

Figure 5A:
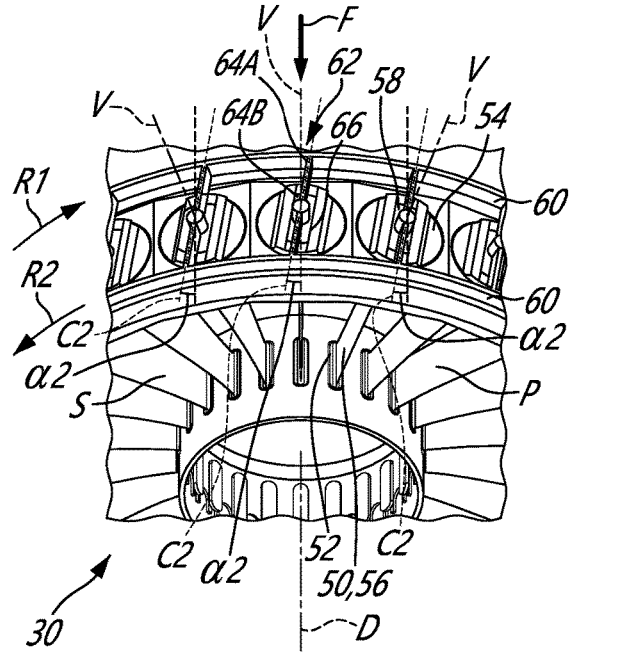
FIGS. 5A-5B are perspective views of the VGV system of FIG. 3, with vanes thereof shown in a deformed state.
Figure 5B:
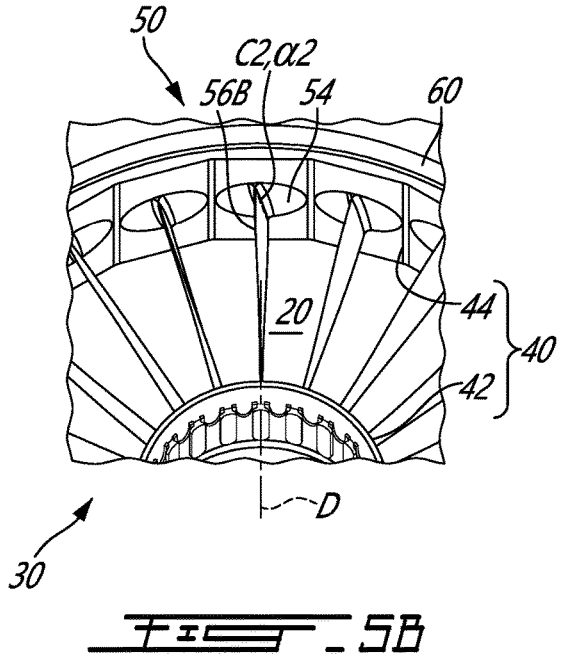

As shown in FIGS. 4A and 4B, upon the inner vane end 52 being attached to the inner duct wall 42 and the outer vane end 54 being received inside the opening 44C, with the vane 50 being in the undeformed state, the second chord C2 is at a first angle $\alpha$1 relative to the duct axis D. In the present embodiment, the first angle $\alpha$1 is null, i.e., the second chord C2 is parallel to the duct axis D. It is contemplated however that other spatial arrangements of the airfoil 56 relative to the duct 40, and hence, other values for the first angle $\alpha$1, are contemplated. The vane 50 is constructed such that as the outer vane end 54 is rotated, the outer vane end 54 and the vane connector 58 remain substantially undeformed, whereas the airfoil 56 elastically deforms As shown in FIGS. 5A and 5B, the vane 50 is in a deformed state, and the second chord C2 is at a second angle $\alpha$2 relative to the duct axis D. In this embodiment, the second angle $\alpha$2 is a maximum angle of attack $\alpha$, corresponding to about 10 degrees. The second angle $\alpha$2 may be an angle of attack $\alpha$ determined to regulate the flow F so as to prevent, or limit, surge or stalling of a rotor of the engine 10 proximate to the VGV system 30. Other values for c are possible depending on the implementation. In the deformed state, the portion of the airfoil 56 defining the first chord C1 is generally undeformed, i.e., the first chord C1 in this case remains parallel to the duct axis D. The portion of the airfoil 56 defining the second chord C2 however is elastically (i.e., reversibly) deformed as torsion in the airfoil 56 occurs as the outer vane end 54 is rotated about the vane axis V. The second angle α2 may be selected such that deformation is sufficient for de-icing the airfoil 56. It should be noted that the vane 50 is constructed such that as the outer vane end 54 is rotated, the outer vane end 54 and the vane connector 58 remain substantially undeformed. To rotate the outer vane end 54, the actuator (not shown) rotates the first and second rings 60 about the duct axis D in opposite directions, schematically shown by arrows R1, R2. In embodiments, the actuator includes a first actuator coupled to the first drive ring 60 and a second actuator coupled to the second drive ring 60. As the rings 60 rotate, the transmission members 62 induce torque to the outer vane end 54 about the vane axis V. In doing so, the beams 64 elastically deflect, as shown in FIGS. 5A, 5B, whereas the beam connector 66 remains generally undeformed. It is contemplated that a single one of the drive rings 60 may be rotated so as to deflect the beam 64 of the corresponding transmission member 64 while the remaining drive ring 60 remains stationary.

The embodiments described in this document provide non-limiting examples of possible implementations of the present technology. Upon review of the present disclosure, a person of ordinary skill in the art will recognize that changes may be made to the embodiments described herein without departing from the scope of the present technology. Yet further modifications could be implemented by a person of ordinary skill in the art in view of the present disclosure, which modifications would be within the scope of the present technology.

The invention claimed is:

1. A variable guide vane system for an aircraft engine, comprising:

an inner duct wall extending circumferentially about a duct axis;

an outer duct wall extending circumferentially about the duct axis radially outward of the inner duct wall relative to the duct axis;

at least one vane extending from an inner vane end attached to the inner duct wall to an outer vane end rotatably connected to the outer duct wall, the outer vane end rotatable relative to the outer duct wall about a vane axis extending at an angle relative to the duct axis;

a first drive ring and a second drive ring extending circumferentially about the duct axis radially outward of the outer duct wall relative to the duct axis, the first drive ring and the second drive ring rotatable about the duct axis, the first and the second drive rings spaced axially from one another relative to the duct axis on wither side of the vane axis; and at least one transmission member located radially outward of the outer duct wall relative to the duct axis and coupling the first drive ring and the second drive ring to the outer vane end;

wherein the first drive ring, the second drive ring, and the at least one transmission member form a unitary piece.

2. The variable guide vane system of claim 1, wherein the first drive ring and the second drive ring are respectively rotatable relative to the other.

3. The variable guide vane system of claim 1, wherein the at least one transmission member includes a beam extending longitudinally from a first beam end joined to the first drive ring to a second beam end joined to the second drive ring.

4. The variable guide vane system of claim 3, wherein the at least one transmission member includes a beam connector and the outer vane end includes a vane connector, the beam connector and the vane connector having complementary shapes hindering rotation of the beam connector relative to the vane connector about the vane axis.

5. The variable guide vane system of claim 4, wherein the beam connector and the vane connector define a prismatic joint.

6. The variable guide vane system of claim 5, wherein the beam connector is a rail and the vane connector is a slot.

7. The variable guide vane system of claim 1, further comprising an annular seal sealingly engaged between an opening surface of the outer duct wall and a peripheral surface of the outer vane end, the opening surface and the peripheral surface respectively extending circumferentially about the vane axis.

8. The variable guide vane system of claim 1, further comprising a retaining ring extending circumferentially about the duct axis radially inward of the inner duct wall relative to the duct axis, the inner vane end attached to the inner duct wall via the retaining ring.

9. An aircraft engine comprising:

a duct defining a flow path, the duct including an inner duct wall and an outer duct wall respectively extending circumferentially about a duct axis and defining radially inner and outer boundaries of the flow path;

at least one vane having an airfoil extending in the flow path from an inner vane end attached to the inner duct wall to an outer vane end pivotally connected to the outer duct wall, the outer vane end pivotable relative to the outer duct wall about a vane axis extending at an angle relative to the duct axis;

a first drive ring and a second drive ring extending circumferentially about the duct axis radially outward of the outer duct wall relative to the duct axis, the first drive ring and the second drive ring spaced axially from one another relative to the duct axis and pivotable about the duct axis;

at least one transmission member including a beam extending from the first drive ring to the second drive ring radially outward of the outer vane end relative to the duct axis, and a beam connector joined to the beam and matingly engaged with the outer vane end to be rotatable with the outer vane end about the vane axis; and an actuator operatively coupled to the first drive ring and the second drive ring to pivot the first drive ring and the second drive ring about the duct axis, wherein the actuator is operatively coupled to the first drive ring and the second drive ring to pivot the first drive ring and the second drive ring in opposite directions relative to the duct axis.

10. The aircraft engine of claim 9, wherein the actuator includes a first actuator operatively coupled to the first drive ring and a second actuator operatively coupled to the second drive ring.

11. The aircraft engine of claim 9, wherein the first drive ring, the second drive ring and the at least one transmission member form a unitary piece.

12. The aircraft engine of claim 9, wherein the duct is an inlet duct.

13. The aircraft engine of claim 9, further comprising a retaining ring extending circumferentially about the duct axis radially inward of the inner duct wall relative to the duct axis, the inner vane end extending to radially inward of the inner duct wall through an opening defined by the inner duct wall, the inner vane end attached to the inner duct wall via the retaining ring.

14. The aircraft engine of claim 13, wherein the opening and the inner vane end have complementary shapes hindering rotation of the inner vane end relative to the vane axis.

15. The aircraft engine of claim 9, wherein the outer vane end includes a vane connector via which the outer vane end matingly engages the beam connector, the vane connector and the beam connector defining a prismatic joint.

16. The aircraft engine of claim 15, wherein the beam connector is a rail and the vane connector is a slot.

17. A variable guide vane system for an aircraft engine, comprising:

an inner duct wall extending circumferentially about a duct axis;

an outer duct wall extending circumferentially about the duct axis radially outward of the inner duct wall relative to the duct axis;

at least one vane extending from an inner vane end attached to the inner duct wall to an outer vane end rotatably connected to the outer duct wall, the outer vane end rotatable relative to the outer duct wall about a vane axis extending at an angle relative to the duct axis;

a drive ring extending circumferentially about the duct axis radially outward of the outer duct wall relative to the duct axis, the drive ring rotatable about the duct axis; and at least one transmission member located radially outward of the outer duct wall relative to the duct axis and coupling the drive ring to the outer vane end such that rotating the drive ring about the duct axis rotates the outer vane end about the vane axis;

wherein the at least one transmission member includes a beam extending longitudinally from a first beam end joined to the drive ring to a second beam end closer to the vane axis than the first beam end, the at least one transmission member engaging the outer vane end proximate to the second beam end; and wherein the at least one transmission member includes a beam connector joined to the second beam end and the outer vane end includes a vane connector, the beam connector and the vane connector having complementary shapes hindering rotation of the beam connector relative to the vane connector about the vane axis.

18. An aircraft engine comprising:

a duct defining a flow path, the duct including an inner duct wall and an outer duct wall respectively extending circumferentially about a duct axis and defining radially inner and outer boundaries of the flow path;

at least one vane having an airfoil extending in the flow path from an inner vane end attached to the inner duct wall to an outer vane end pivotally connected to the outer duct wall, the outer vane end pivotable relative to the outer duct wall about a vane axis extending at an angle relative to the duct axis;

a first drive ring and a second drive ring extending circumferentially about the duct axis radially outward of the outer duct wall relative to the duct axis, the first drive ring and the second drive ring spaced axially from one another relative to the duct axis and pivotable about the duct axis;

at least one transmission member including a beam extending from the first drive ring to the second drive ring radially outward of the outer vane end relative to the duct axis, and a beam connector joined to the beam and matingly engaged with the outer vane end to be rotatable with the outer vane end about the vane axis; and an actuator operatively coupled to the first drive ring and the second drive ring to pivot the first drive ring and the second drive ring about the duct axis;

wherein the outer vane end includes a vane connector via which the outer vane end matingly engages the beam connector, the vane connector and the beam connector defining a prismatic joint.

* * * * *